US005707329A

United States Patent [19]

Pool et al.

[11] Patent Number: 5,707,329

[45] Date of Patent: Jan. 13, 1998

[54] NARROW PROFILE APPARATUS FOR FORMING TUBES FROM PLASTIC WEB STOCK

[76] Inventors: George H. Pool; Dan R. Free, both of 2820 Basswood Rd., Manitowoc, Wis. 54220

[21] Appl. No.: 799,115

[22] Filed: Feb. 11, 1997

[51] Int. Cl.[6] ..... B65B 9/22; B65B 9/06

[52] U.S. Cl. ..... 493/302; 53/551; 53/552

[58] Field of Search ..... 53/551, 552, 451; 493/302, 478

[56] References Cited

U.S. PATENT DOCUMENTS

| | | | |
|---|---|---|---|
| 3,133,390 | 5/1964 | Leasure et al. | 53/551 |
| 3,486,424 | 12/1969 | Tanner | 53/551 X |
| 3,636,826 | 1/1972 | Bowen et al. | 53/551 X |
| 3,785,112 | 1/1974 | Leasure et al. | 493/302 X |
| 3,948,150 | 4/1976 | Hobart . | |
| 3,962,958 | 6/1976 | Hobart | 493/302 X |
| 4,084,999 | 4/1978 | Rucker | 53/551 X |
| 4,262,470 | 4/1981 | Reuter et al. | 53/551 X |
| 4,322,929 | 4/1982 | Neumann | 53/551 X |
| 4,532,754 | 8/1985 | Hokanson | 53/551 X |
| 4,910,943 | 3/1990 | Taylor et al. | 53/551 |
| 4,986,054 | 1/1991 | McMahon | 43/552 X |
| 5,237,798 | 8/1993 | Fukuda | 53/551 |

*Primary Examiner*—Horace M. Culver

*Attorney, Agent, or Firm*—Andrus, Sceales, Starke & Sawall

[57] ABSTRACT

A narrow profile forming collar for forming thermoplastic tubes from a continuous web has a soldered and welded sheet metal construction which provides a compact, rigid forming collar particularly adapted to replace wide profile forming collars. A small unobtrusive mounting bracket is contained fully within the envelope of the forming collar, except for mounting surfaces on the opposite ends which are utilized to support the fill tube and, if needed, an auxiliary web feed roll.

8 Claims, 3 Drawing Sheets

FIG. 3
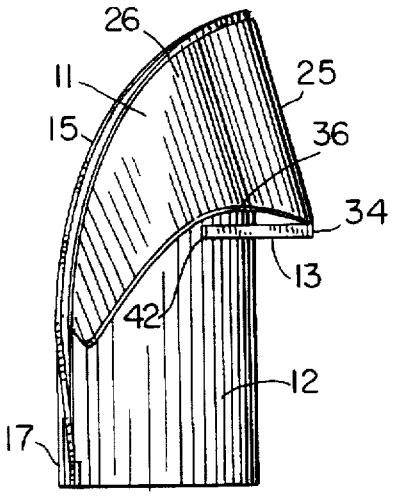
FIG. 7
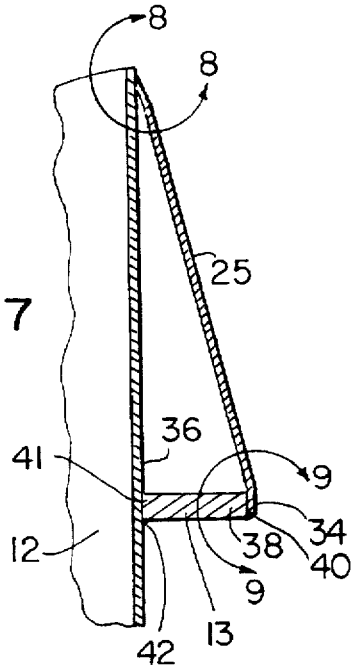
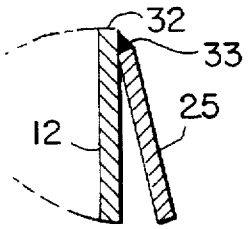
FIG. 8
FIG. 4(a)
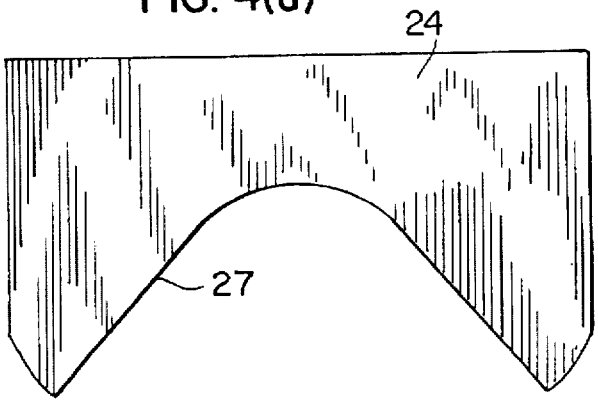
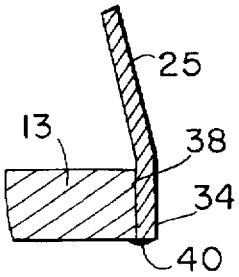
FIG. 9
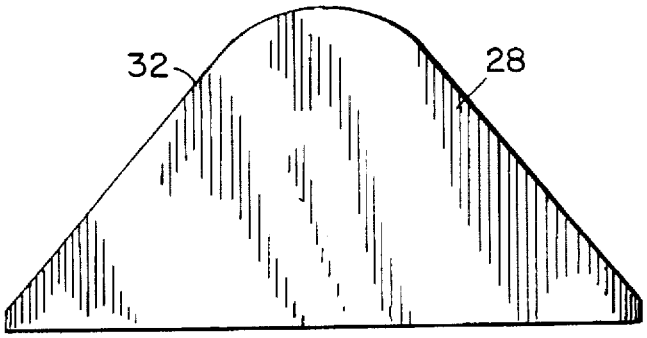
FIG. 4(b)

NARROW PROFILE APPARATUS FOR FORMING TUBES FROM PLASTIC WEB STOCK

BACKGROUND OF THE INVENTION

The present invention pertains to apparatus for the continuous formation of edge seamed and sealed tubular shapes from plastic web stock and, more particularly, to a low profile forming collar for use in such apparatus.

Forming collars for converting a continuous plastic web or laminated webs to a continuous longitudinal edge sealed tube are well known in the art. Such tube forming apparatus is typically utilized in a form, fill and seal system in which the product to be packaged is fed axially through the forming tube through which the plastic web is also drawn after passage over a forming collar attached to the tube along a common curved edge. The web which is formed into a tube shape is sealed along overlapping longitudinal edges, the product is funneled into the plastic tube via a fill tube which passes through the forming tube, and lateral bottom and top closure seals are formed to enclose premeasured portions of the product, all in a manner well known in the industry. The web often is a laminate including layers of non-plastic materials, such as paper, foil and the like, laminated to a plastic web.

For many years, bag forming collars, including an integral wing and tubular body, were made of cast metal, such as bronze. Cast formers were not only expensive to manufacture, but the relatively soft bronze was subject to high wear and consequent shortened useful life. Forming collars fabricated from relatively thinner sheet metal, such as stainless steel, have now generally replaced cast bronze forming apparatus. Because a large number of manufacturers presently make form, fill and seal systems, there is little uniformity in the design and construction of these systems, beyond the general similarity in forming collars and the three functions of forming, filling and sealing the bags. Differences in bag size, web stock thickness, and laminate materials also dictate variations in the size and design of the forming equipment. As a result, forming collars are typically custom designed for a particular manufacturer's equipment and for the web stock being converted. Also, the transition from cast bronze formers to fabricated sheet metal formers led to a departure in certain aspects of the shape of the forming collar. For example, the wing angle or angle which the flat central wing surface (or the back of the collar over which the web enters the former) makes with the vertical axis of the center tube or body has typically become larger. This has likely been due to the relatively less difficulty in fabricating collars from sheet metal with larger wing angles, than forming them with the small angle (e.g. 15°) characteristic of cast bronze forming collars. As the cast bronze formers were replaced, adjustments also had to be made in the position of the feed rolls which direct the plastic web onto the wing surface of the collar. However, as the wing angle increases, proper tracking of the web over the collar becomes more difficult to control.

In addition, fabricated sheet metal replacement collars with increased wing angles are often difficult to install because of the position of existing equipment such as the web feed roll arrangement. There is also an inherent strength problem resulting from the use of sheet metal forming collars in place of cast metal collars. The thin sheet metal sections must be reinforced, particularly the infeed edge of the central wing surface. This is typically accomplished by bending the edge at an acute angle with respect to the wing surface and bolting the bent edge to the main former supporting bracket. The supporting bracket, in turn, is used to support the central fill tube which extends coaxially into the forming tube body.

SUMMARY OF THE INVENTION

In accordance with the present invention, a narrow profile forming collar is provided which is fabricated from sheet metal for direct replacement of either a cast metal former or a fabricated sheet metal former having a large wing angle. The narrow profile forming collar includes a soldered and welded construction which is strong and dimensionally compact to fit readily into many bag forming systems. The forming apparatus of the present invention utilizes a generally conventional shape which includes a tubular sheet metal body with an opening in one end defined by a curved edge, and a sheet metal wing with a generally flat central wing surface that lies at an acute angle with respect to the axis of the tubular body and which blends into integral laterally extending curved shoulders. The wing surface and the shoulders of the collar define an edge which coincides with and is soldered to the curved edge of the tubular body and over which curved edge the web is drawn through the body.

In the forming apparatus of the present invention, the central surface of the wing is provided with a free linear edge opposite the curved edge. A flat metal mounting bracket is formed with a linear edge portion which is welded along its length to the linear edge of the wing. The opposite edge of the mounting bracket has a circular edge portion which is welded along its length to a portion of the outside surface of the tubular body. The mounting bracket has a narrow body portion between the linear and circular edge portions which positions the flat wing surface of the forming collar to define an acute angle of about 15°.

The mounting bracket is provided with mounting surfaces on its opposite ends which extend laterally beyond the shoulders of the wing. In the disclosed narrow profile arrangement, the entire body portion of the mounting bracket, inwardly of the mounting surfaces, lies within the wing. Preferably, the weld of the linear edge portion of the bracket to the linear edge of the wing is continuous. However, the weld of the circular edge portion of the bracket to the surface of the forming tube body is preferably intermittent, but may also be continuous. To accommodate replacement of fabricated forming collars having larger wing angles, the apparatus of this invention may also include a web positioning feed roll which is attached to the mounting surfaces of the mounting bracket to direct the web onto the central flat surface of the wing near the linear edge of the wing.

BRIEF DESCRIPTION OF THE DRAWINGS

FIG. 3 is a side elevation of the apparatus shown in FIG. 2.

FIGS. 4(*a*) and 4(*b*) are plan views of the sheet metal components from which the wing and tubular body of the collar are fabricated.

FIG. 7 is an enlarged sectional detail taken on line 7—7 of FIG. 2.

FIG. 8 is a further enlarged detail of FIG. 7.

FIG. 9 is another enlarged detail of FIG. 7.

DETAILED DESCRIPTION OF THE PREFERRED EMBODIMENT

Figure 1:
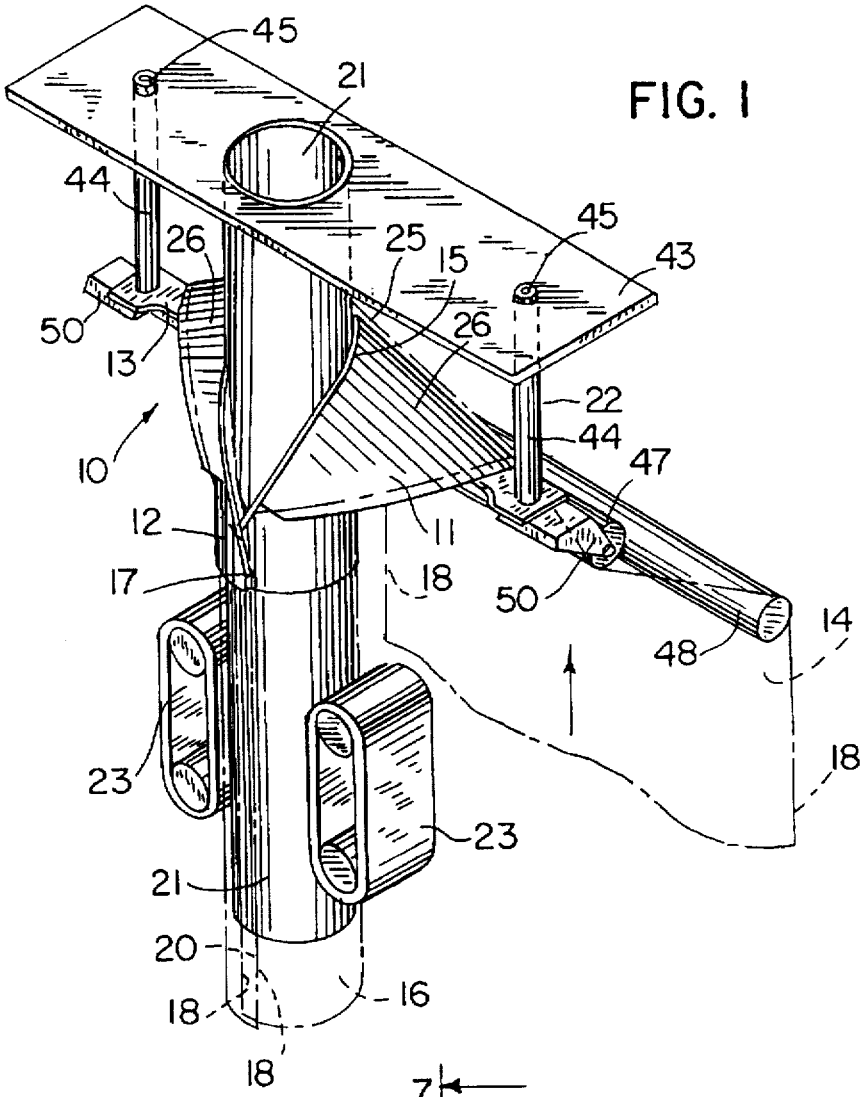
FIG. 1 is a perspective view of the basic form and fill portions of a conventional form, fill and seal system incorporating the narrow profile forming collar of the present invention.
Figure 2:
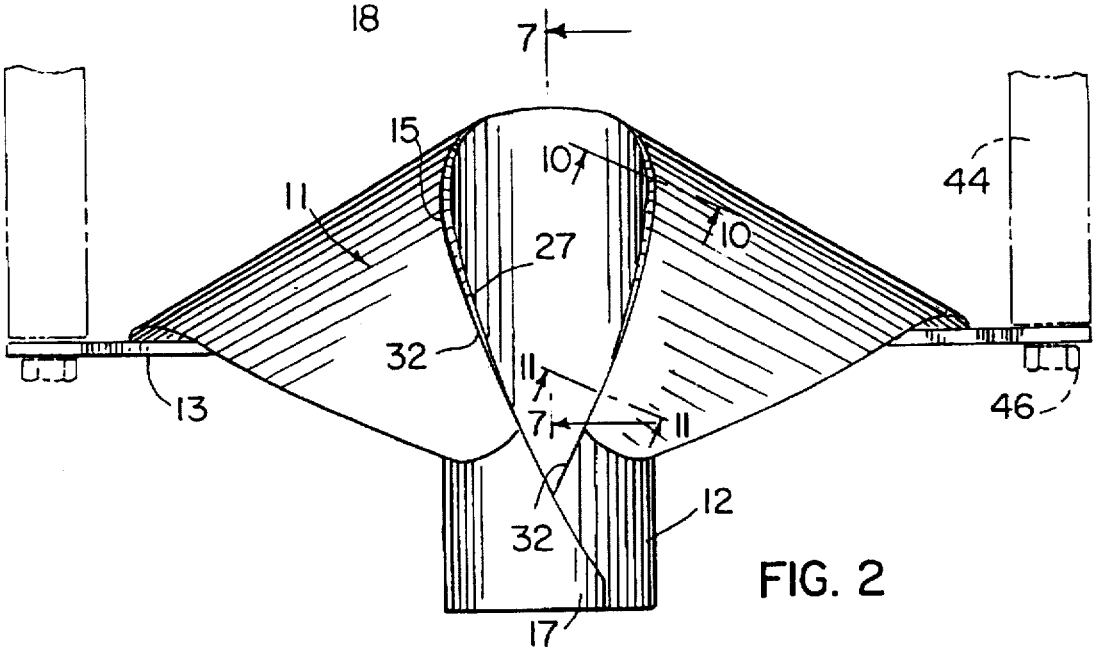
FIG. 2 is an enlarged front elevation of the forming collar of the present invention shown in FIG. 1.

In FIG. 1, the narrow profile forming collar 10 of the present invention is shown incorporated into a form, fill and seal system in which both the longitudinal and lateral sealing devices have been omitted for clarity. The narrow profile collar 10 is fabricated from three components, including a wing 11, a central tubular body 12 and mounting bracket 13. In a manner well known in the art, a thermoplastic web 14 (or a laminated web) of suitable bag stock is directed upwardly over the rear surface of the wing 11, drawn over the common curved edge 15 of the wing and the central tubular body 12 and axially downwardly through the body. The unique shape of the collar 10 causes the web 14 to assume a tubular shape against the inside surface of the tubular body 12. The narrow overlapping ends 17 of the tubular body 12 are spaced slightly apart in a radial direction, causing the lateral edges 18 of the web 14 to overlap. A continuous sealing mechanism (not shown) seals the overlapping lateral edges 18 to provide a continuous longitudinal seal 20 completing the formed thermoplastic tube 16.

A product fill tube 21 is suspended from a suitable mounting apparatus 22 to extend coaxially through the tubular body 12 of the collar to deliver portioned amounts of product into the formed thermoplastic tube 16 which is sequentially laterally sealed by a lateral sealing device (not shown) below the lower end of the fill tube 21. The formed tube 16 is drawn through the former by a pair of drive belts 23 positioned on opposite sides of the fill tube 21 and in contact with the thermoplastic tube 16 on the outside of the fill tube, all in a manner well known in the industry.

Figure 5:
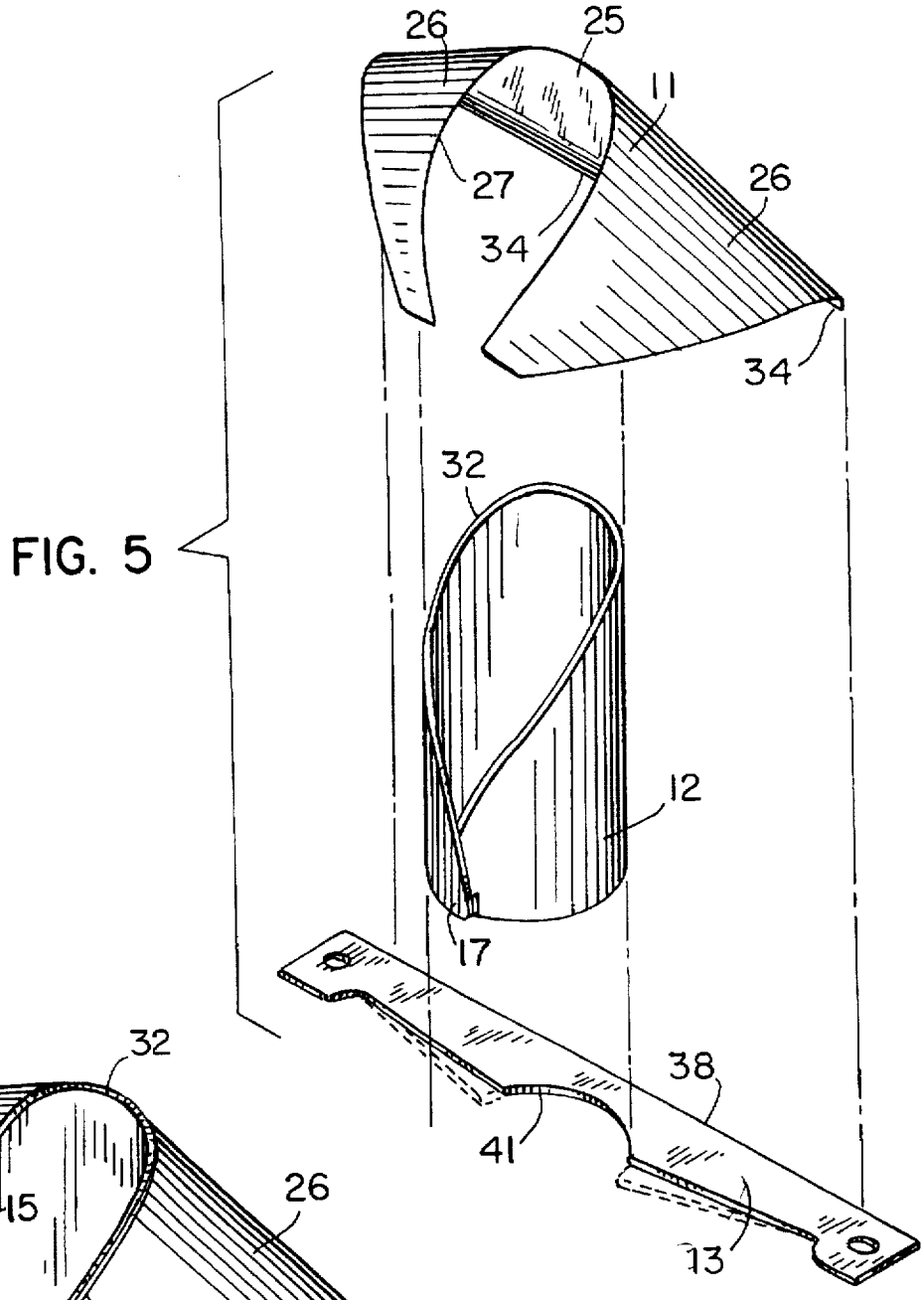
FIG. 5 is an exploded view of the components of the forming apparatus.
Figure 6:
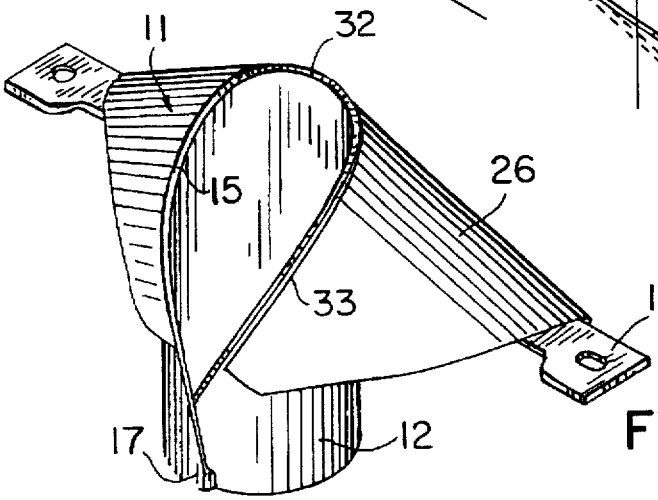
FIG. 6 is a perspective view of the welded assembly of the components shown in FIG. 5.

Referring also to FIGS. 2–6, the wing 11 is formed from a flat sheet metal wing piece 24 (FIG. 4(*a*)) which, in its formed shape (FIG. 5), defines a generally flat central wing surface 25 which blends into integral oppositely extending curved shoulders 26. The free opposite ends of the wing piece 24, defining the ends of the shoulders 26 and forming lapel-like surfaces 29, are bent back toward one another to define a collar edge 27 having a sort of inverted tear drop shape. A flat body piece 28, shown in FIG. 4(*b*) and also made of sheet metal, is formed into a cylindrical tubular body shape, as shown in FIG. 5, with its narrow overlapping ends 30 tacked together with a spacer weld 31 to keep the ends separated and define a narrow longitudinal slot between them. The opening in the formed central tubular body 12 is also defined by a curved edge 32 which corresponds generally to the edge 27 on the wing 11. The wing 11 is joined to the body 12 along their adjoining edges 27 and 32 with a continuous curved silver soldered joint 33. The soldered joint and the curved edge 27 are suitably ground and finished to provide a smooth edge over which the web 14 is drawn down into the body 12 to form the thermoplastic tube 16.

The rear center surface 25 of the wing 11 extends from the upper edge 27 downwardly to a lower free linear edge 34. The surface of the wing is generally flat between its upper and lower edges 27 and 34. In order to provide strength and stability between the wing 11 and the body 12, the linear edge 34 needs to be reinforced or supported, both to prevent deflection of the wing along its surface 25 and with respect to the body itself. The mounting bracket 13 is disposed between and interconnects the linear edge 34 of the wing and a portion of the cylindrical outside surface 36 of the tubular body 12. By forming the angle which the flat surface 25 of the wing 11 makes with respect to the longitudinal axis of the tubular body 12 as small as practicable, e.g. about 15°, a number of advantages are realized. The bag former 10, as best seen in FIG. 3, can be fabricated with a very narrow profile. This assures unobstructed mounting of the collar where conventional sheet metal collars made with large wing angles often encounter obstructions from auxiliary equipment. The narrow profile also allows the use of a narrow mounting bracket 13 which stiffens the assembly considerably, while saving material. The mounting bracket 13 also lies nearly wholly within the collar (see FIGS. 2 and 6) except for mounting surfaces on the opposite ends of the bracket. Finally, narrow profile collars inherently provide better web tracking and thus fewer defects in the formed plastic tube 16.

The mounting bracket 13 includes a linear edge portion 38 which is attached to the linear edge 34 of the wing surface 25 by a continuous weld 40. The opposite edge of the mounting bracket includes a circular edge portion 41 which is attached to a portion of the outer surface 36 of the central tubular body 12 with a suitable welded connection 42 (see FIG. 7). The welded connection 42 may comprise a series of intermittent tack welds or a continuous weld.

A conventional fill tube 21 is attached, as by welding, to a generally rectangular mounting plate 43. The mounting plate and fill tube are supported on the mounting bracket 13 by a pair of tubular support rods 34 attached by suitable upper and lower bolted connections 45 and 46, respectively. Upper bolted connections 45 are positioned so the fill tube 21 is suspended coaxially within the body 12 to create an annular space therebetween for passage of the formed thermoplastic tube 16, as previously described.

If the narrow profile forming collar 10 of the present invention is installed in a system to replace a prior art collar having a much greater wing angle and consequent wider profile, it may be necessary to add an auxiliary web feed roll 47 to reposition the web coming off an existing feed roll 48. This is to assure flat tangent contact between the incoming web 14 and the flat surface 25 of the wing 11. The auxiliary feed roll 47 may be simply and conveniently attached directly to the mounting bracket 13 with a feed roll mount 50, as shown in FIG. 1. The feed roll mount may use the same bolted connections 46 used to the mount the support rods 44.

We claim:

1. A narrow profile forming collar for an apparatus for forming tubes from a continuous web, said collar being of the type having a tubular sheet metal body with an opening in one end defined by a curved edge, and a sheet metal wing with a generally flat central wing surface which lies at an acute angle with respect to the axis of the tubular body and which blends into integral laterally extending curved shoulders, said wing surface and shoulders defining an edge which is soldered to and coincides with the curved edge of the body and over which curved edge the web is drawn through the body, said apparatus comprising:

a free linear edge on the central surface of the wing opposite the curved edge;

a flat metal mounting bracket having a linear edge portion welded along its length to the linear edge of said wing, an opposite circular edge portion welded along its length to a portion of the outside surface of said tubular body, and a narrow body portion between said linear and circular edge portions positioning said flat central wing to define an acute angle of about 15°.

2. The apparatus as set forth in claim 1 wherein said mounting bracket includes opposite end mounting surfaces extending laterally beyond the shoulders.

3. The apparatus as set forth in claim 2 wherein the entire body portion of said bracket inwardly of said mounting surfaces lies within said wing.

4. The apparatus as set forth in claim 1 wherein the weld of said bracket linear edge portion to said wing linear edge is continuous.

5. The apparatus as set forth in claim 1 wherein the weld of said bracket circular edge portion to the surface of said forming tube body is intermittent.

6. The apparatus as set forth in claim 2 including a web positioning feed roll attached to the mounting surfaces of the mounting bracket to direct the web onto the central surface of the wing near the linear edge thereof.

7. The apparatus as set forth in claim 6 including a fill tube support attached to the mounting surface of said mounting bracket.

8. The apparatus as set forth in claim 7 wherein said feed roll and said fill tube support are attached with common demountable connections.

* * * * *